US010186279B2

(12) United States Patent
Rauschmayer

(10) Patent No.: US 10,186,279 B2
(45) Date of Patent: Jan. 22, 2019

(54) DEVICE FOR DETECTING, MONITORING, AND CANCELLING GHOST ECHOES IN AN AUDIO SIGNAL

(71) Applicant: REVX TECHNOLOGIES, Austin, TX (US)

(72) Inventor: Dennis Rauschmayer, Plano, TX (US)

(73) Assignee: RevX Technologies, Austin, TX (US)

( * ) Notice: Subject to any disclaimer, the term of this patent is extended or adjusted under 35 U.S.C. 154(b) by 0 days.

(21) Appl. No.: 15/629,305

(22) Filed: Jun. 21, 2017

(65) Prior Publication Data

US 2017/0365272 A1 Dec. 21, 2017

Related U.S. Application Data

(60) Provisional application No. 62/352,757, filed on Jun. 21, 2016.

(51) Int. Cl.

| | |
|---|---|
| ***G10L 21/0232*** | (2013.01) |
| ***G10L 25/51*** | (2013.01) |
| ***G10L 21/0208*** | (2013.01) |
| ***H04R 29/00*** | (2006.01) |
| ***H04R 3/04*** | (2006.01) |

(52) U.S. Cl.

CPC ..... *G10L 21/0232* (2013.01); *G10L 25/51* (2013.01); *H04R 3/04* (2013.01); *H04R 29/001* (2013.01); *H04R 29/002* (2013.01); *G10L 2021/02082* (2013.01)

(58) Field of Classification Search

CPC ..... G10L 21/0232; G10L 25/51; G10L 2021/02082; H04R 3/04; H04R 29/002

See application file for complete search history.

(56) References Cited

U.S. PATENT DOCUMENTS

| | | | | |
|---|---|---|---|---|
| 5,668,883 | A | 9/1997 | Abe et al. | |
| 5,680,450 | A * | 10/1997 | Dent | H04M 9/082 379/388.02 |
| 2004/0223620 | A1* | 11/2004 | Horbach | H04R 29/002 381/59 |
| 2007/0282467 | A1 | 12/2007 | Rodrigues et al. | |
| 2008/0159554 | A1 | 7/2008 | Sung et al. | |
| 2010/0290643 | A1* | 11/2010 | Mihelich | H04S 7/301 381/99 |
| 2010/0310101 | A1 | 12/2010 | Anderson | |
| 2011/0274307 | A1 | 11/2011 | Lynch | |
| 2012/0243716 | A1* | 9/2012 | Puder | H04R 25/453 381/318 |

(Continued)

FOREIGN PATENT DOCUMENTS

EP 0811288 B1 10/2001

OTHER PUBLICATIONS

International Search Report and Written Opinion for Application No. PCT/US2017/038543 dated Sep. 11, 2017 (11 pages).

*Primary Examiner* — Sonia L Gay
(74) *Attorney, Agent, or Firm* — Lee & Hayes, P.C.

(57) ABSTRACT

In some examples, devices for detecting and measures a ghost echo current in an audio signal are described. For instance, the device may be configured to sample a current of an audio signal, compare with an expected current, and determine an impulse response of the ghost echo current based on the sampled current and the expected current. The device may also be configured to reduce the ghost echo current using the impulse response.

20 Claims, 13 Drawing Sheets

(56) References Cited

U.S. PATENT DOCUMENTS

| | | | | |
|---|---|---|---|---|
| 2015/0263692 | A1* | 9/2015 | Bush | H03G 5/165<br>381/122 |
| 2017/0064485 | A1* | 3/2017 | Song | H04S 5/02 |

* cited by examiner

DEVICE FOR DETECTING, MONITORING, AND CANCELLING GHOST ECHOES IN AN AUDIO SIGNAL

BACKGROUND

Typically, sound is produced by driving a current through wires to a speaker that outputs the current as sound. The current causes the speaker driver to vibrate or move resulting in the creation of the sound. The motion of the speaker driver produces sound pressure that may travel out of the speaker enclosure and ultimately is received at an ear of the listener.

In some cases, the sound pressure created by the speaker travels into the ear upon which the audio device is worn. In some situations, the sound pressure may be reflected back towards the speaker by the eardrum. Some portion of the sound pressure is captured by the speaker driver acting as a microphone creating current that is fed back into an amplifier of the sound system generating the audio signal being output by the audio device. This current, termed, ghost current will mix destructively with the current being generated by the amplifier based on the desired audio signal and degrade the quality of the audio being output by the audio device.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
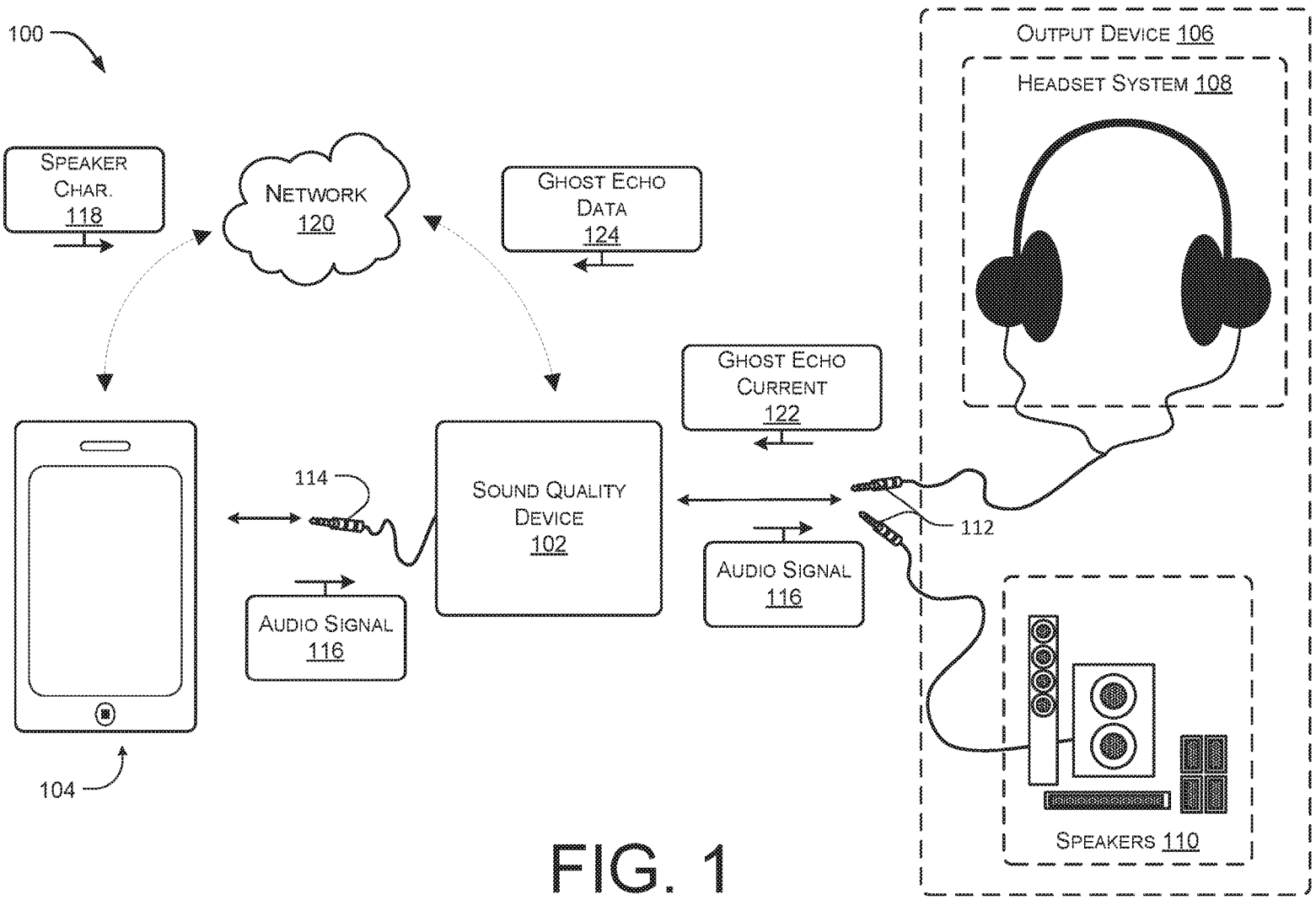
FIG. 1 illustrates an example system including a sound quality device according to some implementations.

This disclosure includes techniques and implementations to improve quality of sound output by speakers, in-ear monitors, or headsets. In particular, this disclosure describes ways to detect, monitor, and reduce ghost echoes introduced into sound output by a speaker. A ghost echo as, used herein, describes sound output by a speaker resulting from a ghost echo current introduced into the audio signal by a reflection of sound pressure created in response to movement of a speaker driver and captured by the speaker. For example, sound is produced by diving a current through a speaker. The current causes the speaker driver to vibrate or move as the sound is output into an environment. The motion of the driver generates sound pressure waves that travel out of the speaker enclosure into an environment. In one example, the speaker may be part of a headset and the sound pressure wave created by the speaker may travel into the ear of a listener upon which the speaker is worn. In some situations, the sound pressure wave may be reflected back towards the speaker by the eardrum. Some portion of the sound pressure wave is captured by the speaker driver (which may act as a microphone) and is fed back to the audio source (such as an amplifier) as a ghost echo current. The ghost echo current may mix with the current generated by the audio source based on the audio signal being output. The ghost echo current is then output by the speaker as noise, thereby degrading the quality of the sound being output.

Described herein, are devices and methods for detecting the presence of a ghost echo current in the audio signal or a ghost echo (e.g., the sound generated by the ghost echo current) in the speaker output, measuring the magnitude of the ghost echo current or the ghost echo, and removing the ghost echo current form the audio signal and/or the ghost echo from the sound output by the speaker. For example, in some implementations, a sound quality device is described. The sound quality device may be configured to releasably couple between an audio source and an output device (e.g., a speaker) to detect, monitor, and/or remove a ghost echo from sound generated by the output device in substantially real time.

In one example, the sound quality device may include a current sense to determine a current of an audio signal being output by the audio source. The current measured by the current sense may be provided to a processor or compare circuit. The processor or compare circuit may evaluate the measured current based on an estimated current. In one particular example, a speaker model, representative of the speaker used to output the audio, may be applied to the audio signal to generate an estimated current. Thus, the estimated current may be representative of a desired current if environmental factors are excluded. In this manner, when the measured current is compared with the estimated current, the difference may be representative of the ghost echo current resulting from the reflection of the sound pressure wave created by the movement of the speaker driver.

In some implementations, the sound quality device may include a communication interface (such as a wireless communication interface) to enable the sound quality device to receive the audio signal, speaker identification information, and/or speaker characteristics. The communication interface may also enable the sound quality device to access one or more databases or third party systems to obtain one or more characteristics of the speaker. A computer readable media may also be included on the sound quality device to store speaker models and/or the characteristics associated with the speaker that may be utilized by the speaker models when determining the estimated current.

FIG. 1 illustrates an example system 100 including a sound quality device 102 according to some implementations. In the illustrated example, the sound quality device 102 is shown as a separate device that may couple between an audio source 104 and an output device 106, such as the headset 108 (ear buds) or one or more of the speaker(s) 110. For example, the output device 106 may couple to the sound quality device 102 via a TRS jack or other type of audio input 112 and the sound quality device 102 may also couple to the amplifier 104 via a TRS jack or other type of audio input 114.

In some cases, the sound quality device 102 may be configured to sample a current of an audio signal 116 to determine a measured current associated with the audio signal 116 being output by the output device 106. In some cases, sound quality device may sample a series of currents that may be averaged or otherwise utilize to determine the measured current. In one particular example, a voltage may be measures at before and after a known resistive value and the measured current may be equal to the voltage after the known restive value minus the voltage prior to the known restive value divided by the resistor value.

In some examples, a speaker characteristic 118 and/or a speaker may be provided to the sound quality device 102 to assist in determining an estimated current. In the illustrated example, the speaker characteristic 118 may be received by the sound quality device 102 from the audio source 104 via a network 120 (e.g., a short range wireless communication network, such as Bluetooth®). In one example, the audio source 104 may store a sound quality application that may be utilized by a user of the audio source 104 to select or enter information associated with the output device 106 being used. In one instance, the user may enter a make and model of the speaker or headset and the sound quality application operation on the audio source 104 may look up the speaker characteristics 118 in a look up table stored on the audio source 104 or via one or more networks (such as the Internet®) and provide the speaker characteristic 118 to the sound quality device 102.

The sound quality device 102 may model the speaker output to generate an estimated current based on the speaker characteristic 118 using one or more speaker models. The estimated current may be compared to the measured current to determine the ghost echo current 122. The ghost echo current 122 or ghost echo data 124 may be provided back to the audio source 104 or to another system or device. In other cases, the sound quality device 102 may remove or reduce the ghost echo current 122 from the audio signal 116 or prevent the ghost echo current 122 from reaching the audio source 104. For example, an analog ghost echo processing component or circuit may be included in the sound quality device 102. The analog circuit may include a forward transfer function component that is configured to allow a forward current to pass and a reverse transfer function component that is configured to reduce reverse current. For instance, the ratio of the forward transfer function to the reverse transfer function may be greater than one and, in other cases, greater than two.

Figure 2:
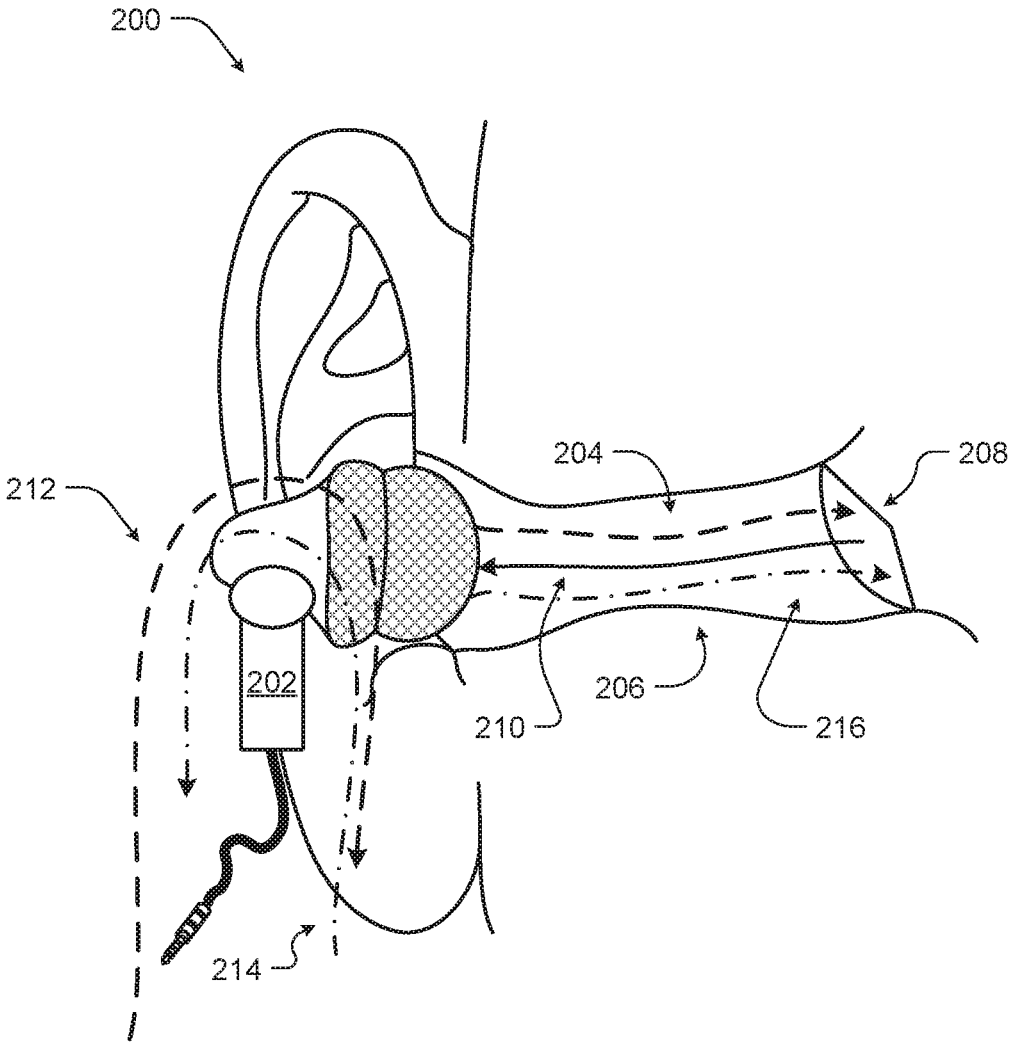
FIG. 2 illustrates an example of a ghost echo being introduced into an audio signal according to some implementations.

FIG. 2 illustrates an example of a ghost echo being introduced into an audio signal according to some implementations. In the illustrated example, an earbud 202 is utilized as an output device. The earbud includes a speaker (not shown) that generates sound pressure 204 that travels down the ear canal 206 to the eardrum 208. When the sound pressure 204 impacts the eardrum 208, some of the sound pressure is reflected back to towards the speaker (e.g., the acoustic reflection 210). Inside the earbud, the acoustic reflection 210 is captured by the speaker that converts the acoustic reflection 210 into a ghost echo current 212. The ghost echo current 212 mixes with the audio signal to generate a modified audio signal 214 that is output by the speaker. When the speaker outputs the modified audio signal 214, the output includes a ghost echo 216 in addition toe the sound pressure 204 associated with the original audio signal. Thus, noise 216 representative of the ghost echo current 212 is output by the speaker and travels to the eardrum 208 and is heard by the user.

Additionally, the ghost echo 210 reflecting off the eardrum 208 is not constant across frequencies. For example, due to non-uniformity of the ear canal 206, the ghost echo 210 may be a summation of multiple reflections from different surfaces inside of the ear canal 206 in addition the reflection off of the eardrum 208. Thus, the ghost echo 210 over a finite time period and has an impulse response that is non-unity. Additionally, it should be understood that, a ghost echo 210 may be created inside of the earbud 202 due to reflections from the actual components of the earbud 202 itself including the plastics and rubber used to make the earbud 202.

In some cases, the speaker may also be associated with an over-the-ear arrangement. In a headphones with an over-the-ear arrangement, a speaker driver is large than the speaker drivers used in earbuds 202 Additionally, due to the headphone placement outside of the ear canal 206, the sound pressure 204 leaving the headphone is exposed to not only the ear canal, but also parts of the outer ear pinna and potentially even parts of the side of the forehead. In this manner, the sound pressure reflection (e.g., the ghost echo 210) from the additional surfaces may increase the ghost echo current 212.

In other cases, the output device may be one or more speakers positioned outside of the ear, such as in a surround sound system. In these cases, where one or more speakers are used to produce sound a ghost echo 210 may still exist. For example, the sound pressure 204 is output by the speaker and may reflect off of furniture, walls, people, or other obstacles in the environment. The reflected sound waves (e.g., the ghost echo 210) are again captured by the speaker and introduced via a ghost current 212 into the audio signal 214. Additionally, if more than one speaker is used (such as in stereo audio systems), a ghost echo 210 may be created by the output of each speaker and each speaker may capture the ghost echo 210 introduced into the environment by itself and the other speakers. Thus, the effect of the ghost echo on sound quality exists in situations in which the speaker is removed from the ear 200

Figure 3:
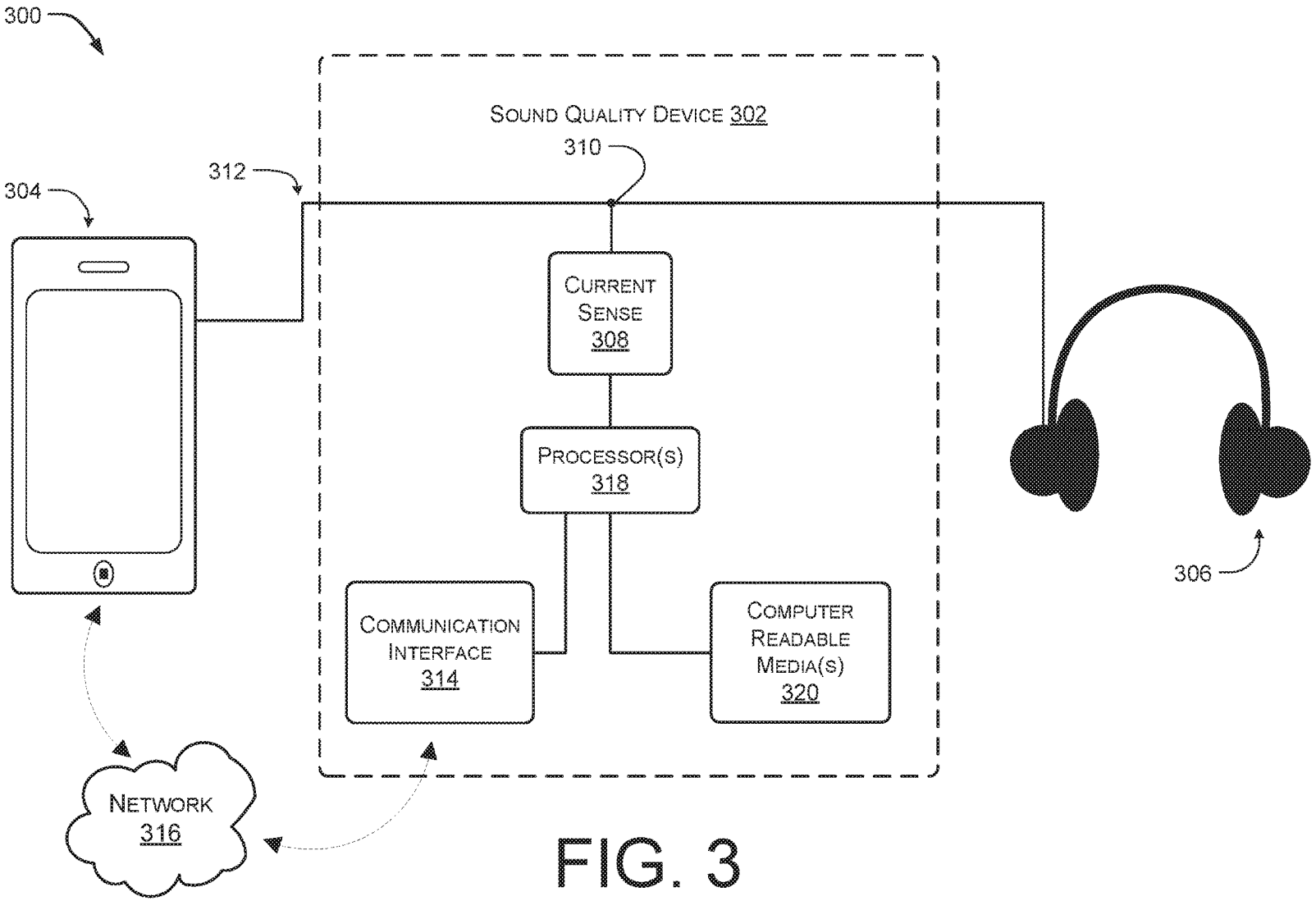
FIG. 3 illustrates a partial circuit diagram showing select components of a sound quality device of a system according to some implementations.

FIG. 3 illustrates a partial circuit diagram 300 showing select components of a sound quality device 302 of a system according to some implementations. In the illustrated example, the sound quality device 302 is coupled between an audio source 304 and the output device 306 to detect and measure a ghost echo current associated with the audio signal output by the audio source 304.

The sound quality device 302 includes a current sense 308 to measure a current at a location 310 along a path 312 between the audio source 304 and the output device 306. The current measured at the location 310 by the current sense 308 may be representative of the current associated with an audio signal plus a ghost echo current introduced by the speaker of the output device 306, as described above.

The audio signal, speaker characteristics, speaker model, and/or an estimated current (determined by the audio source 304) may be provided to a communication interface 314 of the sound quality device 302 via a network 316. In some cases, the network 316 may be representative of wired technologies (e.g., wires, USB, fiber optic cable, etc.), wireless technologies (e.g., RF, cellular, satellite, Bluetooth, etc.), or other connection technologies. The network 316 may be representative of any type of communication network, including data and/or voice network, and may be implemented using wired infrastructure (e.g., cable, CAT5, fiber optic cable, etc.), a wireless infrastructure (e.g., RF, cellular, microwave, satellite, Bluetooth, etc.), and/or other connection technologies. The network 316 may carry data (for example, speaker characteristics) between the sound quality device 302 and the audio source 304.

In one example, a processor 318 of the sound quality device 302 may receive the audio signal from the communication interface 314. A computer-readable media 320 may also be configured to store one or more speaker models and/or speaker characteristics associated with the output device 306 to model an estimated current based on the audio signal. Thus, in this example, the processor 318 may determine, from the audio signal, the estimated current of the audio signal using the speaker models and/or the speaker characteristics stored on the computer readable media 320 accessible by the processor 318.

In general, the computer-readable media 320 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 318

In another example, the communication interface 314 may receive the audio signal and speaker characteristics from the audio source 304. In this example, the processor 318 may apply the audio signal to stored speaker model using the received speaker characteristics. For instance, the audio source 304 may allow the user to enter or access information related to the output device 306 to determine the speaker characteristics. The speaker characteristics may be provided to the sound quality device.

Once the estimated current is determined, the processor 318 may compare the estimated current to the measured current to determine a difference. In some cases, the difference may be considered the ghost echo current. In other cases, the processor 318 may apply a channel estimation to the measured current to determine a first impulse response associated with the measured current. The processor 318 may also apply the channel estimation to the estimated current to determine a second impulse response associated with the estimated current. The processor 318 may then compare the first impulse response to the second impulse response to determine an impulse response of the ghost echo.

Figure 4:
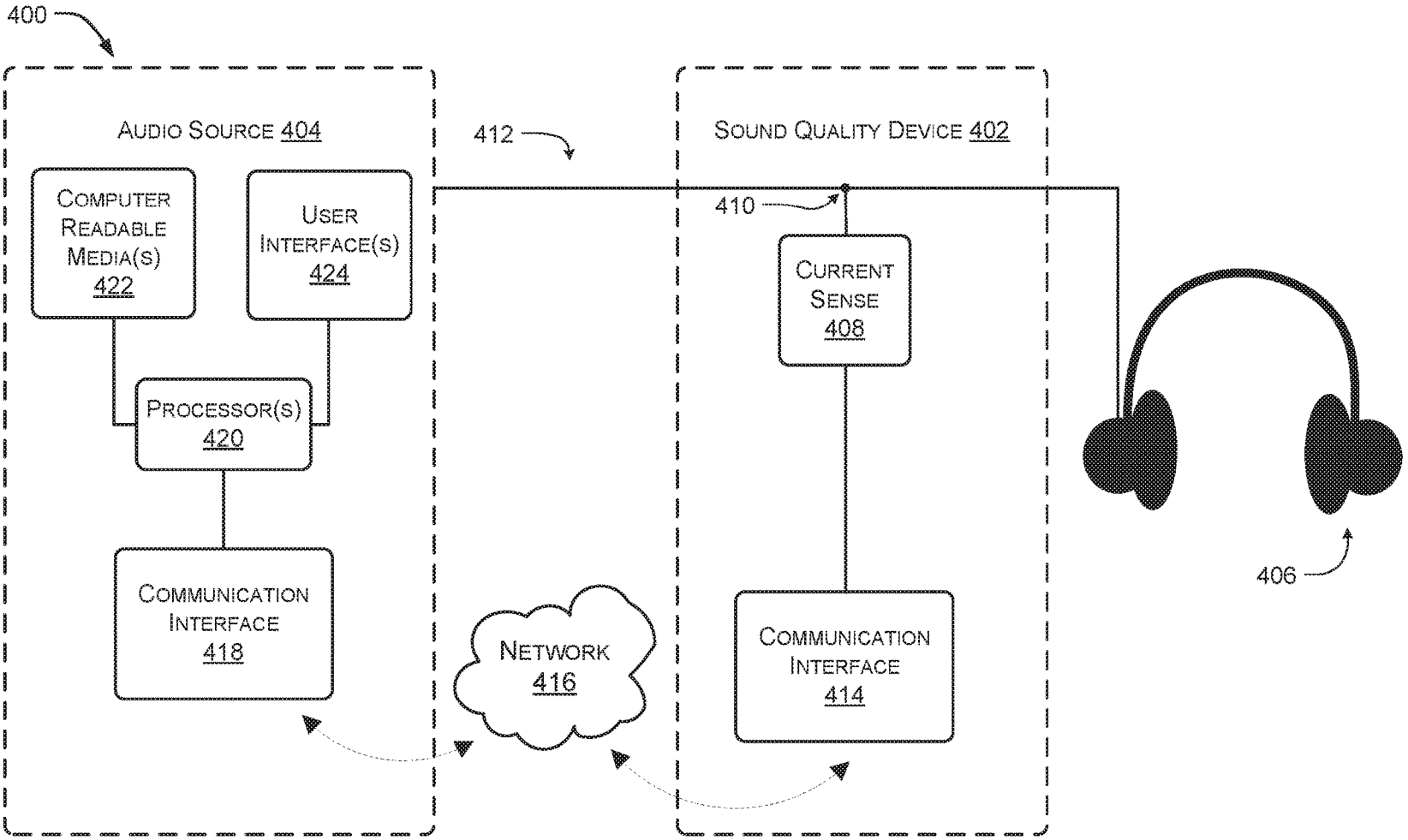
FIG. 4 illustrates a partial circuit diagram showing select components of a sound quality device of a system according to some implementations.

FIG. 4 illustrates a partial circuit diagram showing select components of a sound quality device 402 of a system 400 according to some implementations. In the illustrated example, the sound quality device 402 is again coupled between an audio source 404 and the output device 406. In this example, the sound quality device 402 may be configured to measure a ghost echo current associated with the audio signal and provide the ghost echo current or data related to the ghost echo current to the audio source 404 for further processing.

The sound quality device 402 includes a current sense 408 to measure a current at a location 410 along a path 412 between the audio source 404 and the output device 406. The current measured at the location 410 by the current sense 408 may be representative of the current associated with an audio signal plus a ghost echo current introduced by the speaker of the output device 406, as described above.

The measured current may be provided to a communication interface 414 of the sound quality device 402 via a network 416. The communication interface 414 may establish a communication channel (such as a Bluetooth® connection) with a communication interface 418 associated with the audio source 404.

In one example, a processor 420 of the audio source 404 may process the audio signal using speaker characteristics and/or speaker models stored in a commuter readable media 422 or input by the user via a user interface 424. For example, the processor 420 may generate an estimated current representative of the audio source without a ghost echo current. The processor 420 may compare the measured current received from the sound quality device 402 to the estimated current to determine the ghost echo current. In other cases, the processor 420 may apply a channel estimation to the measured current to determine a first impulse response associated with the measured current. The processor 420 may also apply the channel estimation to the estimated current to determine a second impulse response associated with the estimated current. The processor 420 may compare the first impulse response to the second impulse response to determine an impulse response of the ghost echo.

Figure 5:
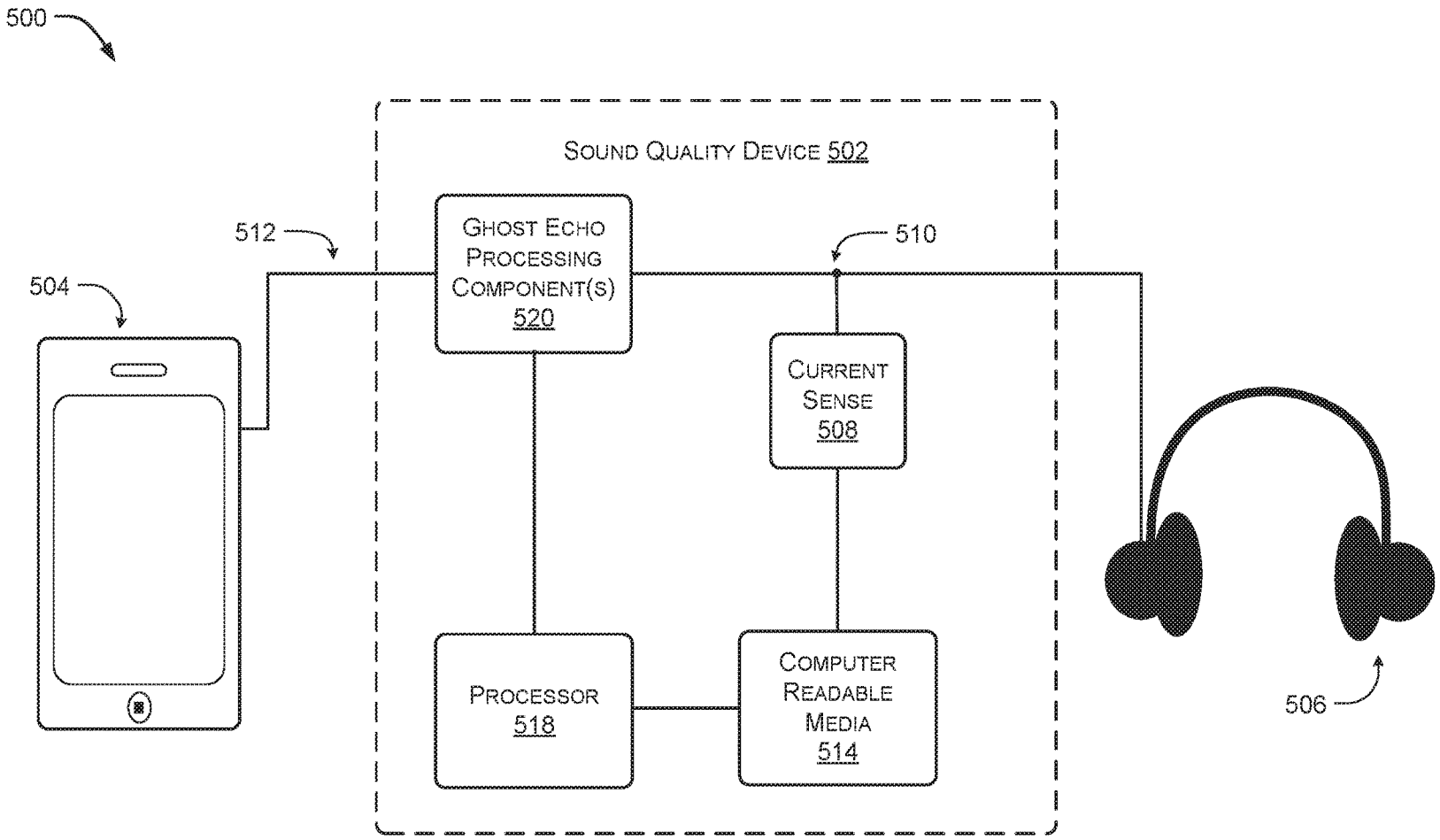
FIG. 5 illustrates a partial circuit diagram showing select components of a sound quality device of a system according to some implementations.

FIG. 5 illustrates a partial circuit diagram showing select components of a sound quality device 502 of a system 500 according to some implementations. In the illustrated example, the sound quality device 502 is once again coupled between an audio source 504 and the output device 506. In this example, the sound quality device 502 may be configured to detect, measure, and remove a ghost echo current associated with the audio signal output by the audio source 504.

In the illustrated example, the sound quality device 502 includes a current sense 508 to measure a current at a location 510 along a path 512 between the audio source 504 and the output device 506. The current measured at the location 510 by the current sense 508 may be representative of the current associated with an audio signal plus a ghost echo current introduced by the speaker of the output device 506, as described above.

In the illustrated example, the sound quality device 502 may have no knowledge related to the speakers or output device 506 being used to output the audio signal along path 512. Initially, the user may be promoted (e.g., via the display of the audio source 504) to couple the output device 506 to the sound quality device 502. The audio source 504 may also prompt the user to place the output device 506 a predetermined distance from any objects within the environment (e.g., more than 2 feet from an object or wall). For example, to point an earbud or speaker at a ceiling. The audio source 504, in response to an indication from a user that the speaker is an appropriate distance from objects within the environment, may then cause the output device 506 to output wideband audio or other known audio signals as sound. The current sense 508 may then capture a first current and store the first current in the computer readable media 514.

The audio source 504 may then prompt the user to place the output device 506 in the desired listening position or orientation. The audio source 504 may next cause the output device 506 to output the known audio signals as sound a second time. The current sense 508 may capture a second current and store the second current in the computer readable media 514.

A processor 516 may compare the first current and the second current to determine a speaker model or one or more settings associated with a ghost echo processing component 520. The processor 518 may pass the model and/or the settings to a ghost echo processing component 520.

Figure 6:
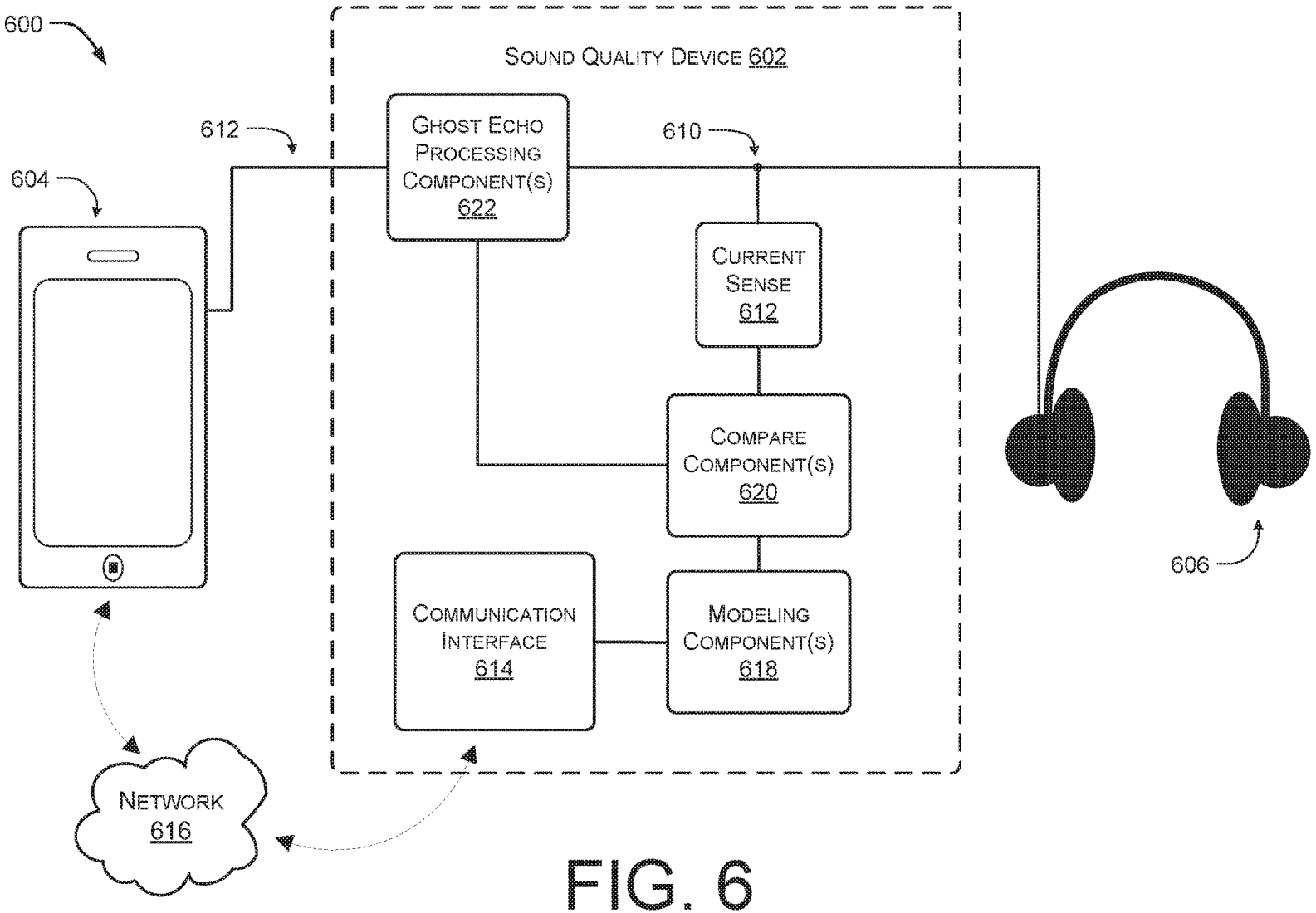
FIG. 6 illustrates a partial circuit diagram showing select components of a sound quality device according to some implementations.

The ghost echo processing components 520 may adjust the current generated by the audio source 504 for output by the output device 506 and traveling along the path 512 based at least in part on the settings received from the processor 518. The adjustment may be made based on difference between a modeled expected current and a sensed current. For example, the current sense 508 may capture a sensed current that may be compared by the processor 518 to the expected current. The difference may be provided to the ghost echo processing component 520 to enable the ghost echo processing component 520 to remove the ghost echo current from the audio signal. FIG. 6 illustrates a partial circuit diagram showing select components of a sound quality device 602 of a system 600 according to some implementations. In the illustrated example, the sound quality device 602 is once again coupled between an audio source 604 and the output device 606. In this example, the sound quality device 602 may be configured to detect, measure, and remove a ghost echo current associated with the audio signal output by the audio source 604.

In the illustrated example, the sound quality device 602 includes a current sense 608 to measure a current at a location 610 along a path 612 between the audio source 604 and the output device 606. The current measured at the location 610 by the current sense 608 may be representative of the current associated with an audio signal plus a ghost echo current introduced by the speaker of the output device 506, as described above.

The audio signal, speaker characteristics, and/or speaker models may be provided to a communication interface 614 of the sound quality device 602 via a network 616. The audio signal, speaker characteristics, and/or speaker models may be received by modeling components 618. The modeling components 618 may generate an estimated current representative of the audio signal without a ghost echo current having been introduced.

Both the estimated current and the measured current may be received by one or more compare components 620. The compare components 620 may determine a difference between the estimate current and the measured current (e.g., the ghost echo current). For example, the compare components 620 may include a subtraction and averaging block to estimate ghost current.

The ghost echo current is provided to a ghost echo processing components 622. The ghost echo processing components 622 may adjust the current generated by the audio source 604 for output by the output device 606 and traveling along the path 612 based at least in part on the ghost echo current received form the compare components 620. For example, the ghost echo processing components 622 may include a digital preprocessor. The digital preprocessor may execute a process (such as an iterative process) to modify the impulse response along 612 to cancel or minimize the ghost current indicated by 620. The third impulse response equal to a convolution operation of the second impulse response and an inverse of the first impulse response.

In another example, the compare components 620 may be an adjustable digital preprocessor. The adjustable digital preprocessor may apply a least mean squares algorithm or other adaptable algorithm to reduce the ghost echo current. For example, the algorithm running in 622 may be configured to adjust the impulse response along 612 in order to minimize the ghost current feedback value coming from 620 and in doing so minimize the ghost current sensed by 612. In one particular case, the compare components 620 may comprise a least mean square filter arrangement to remove the ghost echo current.

In some cases, the ghost echo current may be determined by the compare component 620 at periodic times and the ghost echo current determined at each of the periodic times may be used to configure the ghost echo processing component 622. In other cases, the ghost echo current may be sensed and determined in a continuous or in substantially real-time to and provided to the ghost echo processing component 622 as an input such as a control signal. For example, the ghost echo processing component 722 may be an analog circuit that includes a forward transfer function component to allow a portions or majority of the current associated with the audio signal to pass and a reverse transfer function component that reduces current in a reverse direction. For instance, a ratio of the forward transfer function to the reverse transfer function is greater than one or, in some instances, greater than two. Thus, using the difference in current between the modeled current and the sensed current as an input may cause the ghost echo processing components 622 to eventually reduce the ghost echo current to negligible levels.

Figure 7:
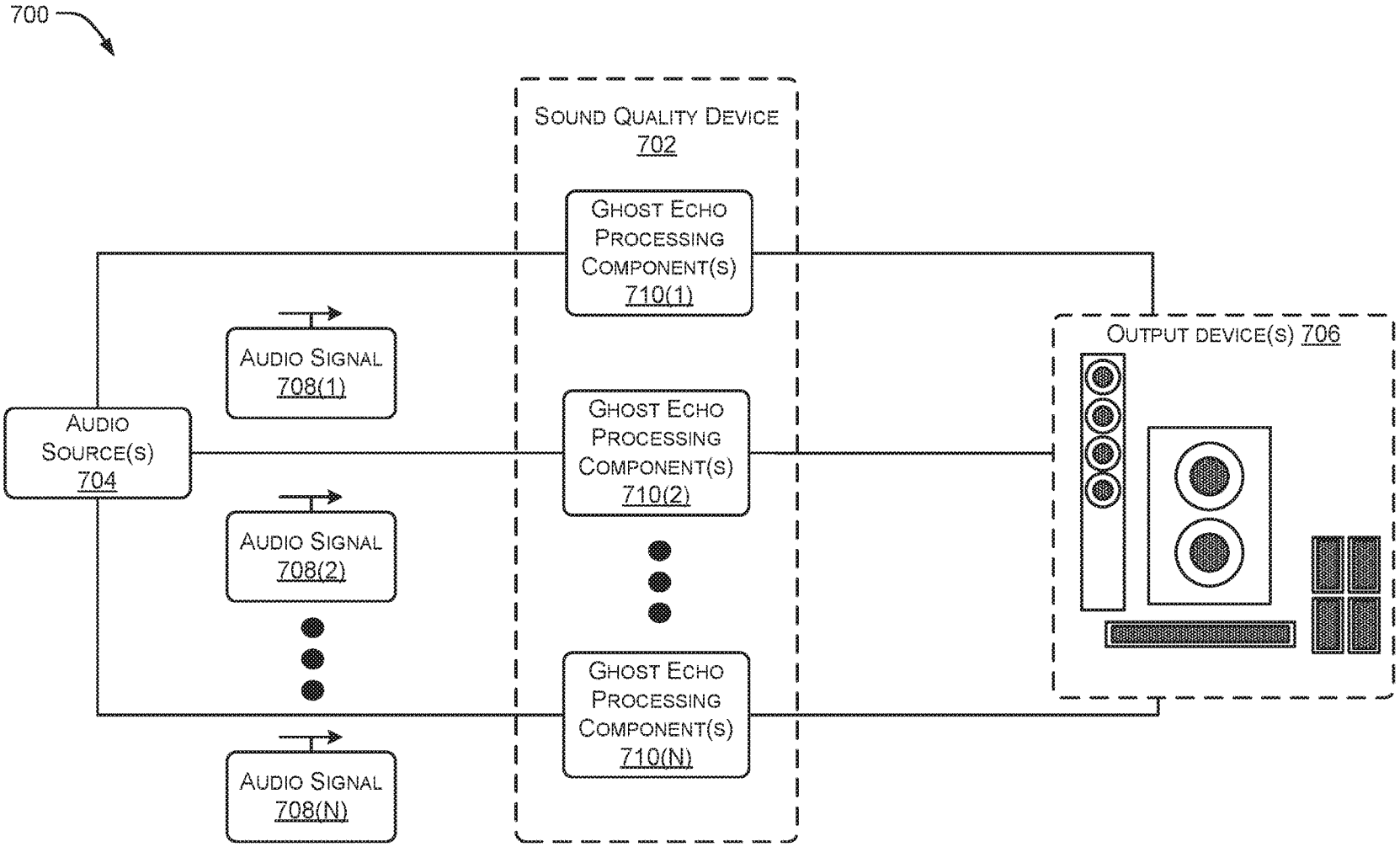
FIG. 7 is an example flow diagram showing an illustrative process for measuring a ghost echo according to some implementations.

FIG. 7 illustrates a partial circuit diagram showing select components of a sound quality device 702 of a system 700 according to some implementations. The sound quality device 702 may be configured to couple inline between an audio source 704 and an output device 706. In the illustrated example, the audio source 704 may generate multiple audio signals 708(1)-(N) that may be output by a different output device 706 (such as a different speaker of a surround sound system). In this example, each of the audio signals 708(1)-(N) may be processed by an individual ghost echo processing components 710(1)-(N).

In some cases, each of the ghost echo processing components 710(1)-(N) may be configured to measure a current and/or impulse response of the corresponding audio signal 708(1)-(N), determine an estimated current and/or impulse response associated with the corresponding audio signal 708(1)-(N), and determine a ghost echo current and/or impulse response of the ghost echo current.

FIGS. 8-11 are flow diagrams illustrating example processes associated with the circuits of FIGS. 3-7. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

Figure 8:
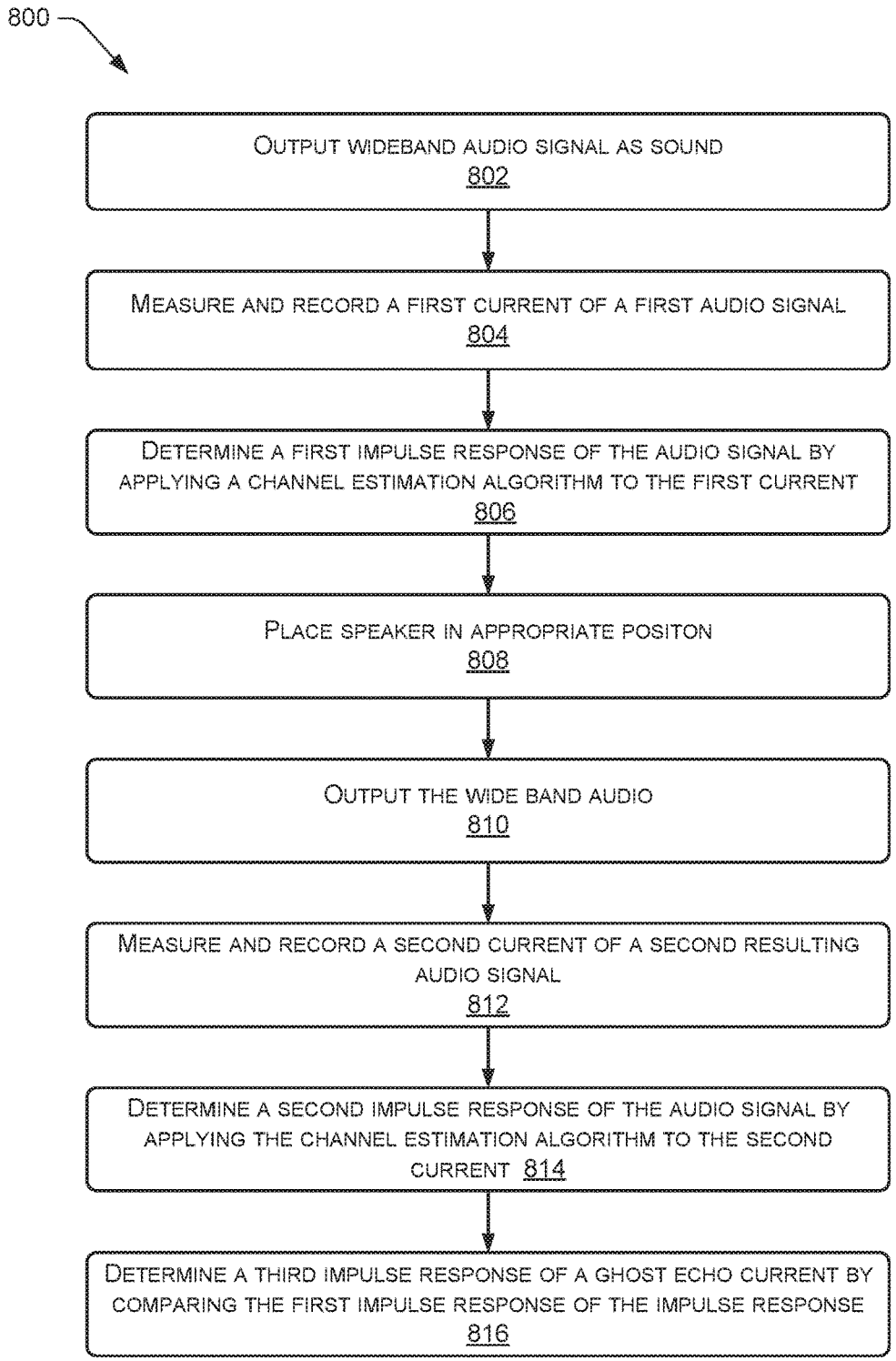
FIG. 8 is another example flow diagram showing an illustrative process for measuring a ghost echo according to some implementations.

FIG. 8 is an example flow diagram showing an illustrative process 800 for measuring a ghost echo according to some implementations. As described above, when sound is produced by diving a current through a speaker. The current causes the speaker driver to vibrate or move in order to output the sound into the environment. The motion of the driver generates sound pressure waves that travel out of the speaker enclosure into an environment. In one example, the speaker may be part of a headset and the sound pressure wave created by the speaker may travel into the ear of a listener upon which the speaker is worn. In some situations, the sound pressure wave may be reflected back towards the speaker by the eardrum. Some portion of the sound pressure wave may be captured by the speaker driver (which may act as a microphone) and converted to current which is fed back to the audio source. The ghost echo may mix with the current generated by the audio source based on the audio signal being output. The ghost echo current is output by the speaker as noise, thereby degrading the quality of the sound being output.

At 802, a speaker may output wideband audio as sound into an environment. For example, an audio source may cause the speaker to output the wideband audio into an environment that is free of acoustic reflection. In some cases, the wideband audio may be white noise, running water, static, or other similar types of sounds.

At 804, a device, such as the sound quality device of FIGS. 3-7, may measure and record a first current of a first resulting audio signal associated with the wideband audio. For example, since the speaker is located in an environment without acoustic reflection, the first current measured may be measured while the wideband audio is output as sound and is representative of the current of the audio signal without the introduction of a ghost echo current. The first current may then be stored or recorded on a computer readable media (e.g., computer readable media 320 or computer readable media 422).

At 806, a first impulse response of the audio signal is determined by applying a channel estimation algorithm to the first current. For example, a least mean square algorithm may be applied to the first current to determine a transfer function of the audio signal in the environment free of acoustic reflections. In some cases, the impulse response of the first current may be stored with the first current or in lieu of the first current, as discussed above at 704.

At 808, the speaker may be placed in an appropriate position. The speaker may be placed in a second environment at which the speaker is intended to be used. For example, earbuds or headphones may be placed in or over the ear of a listener, respectively. A speaker may be placed in a home, office, etc.

At 810, the speaker may output the wideband audio into the second environment. For example, the second environment may be an environment in which acoustic reflection is present and, thus, the speaker causes the introduction of a ghost echo current during output. As discussed above, in some cases, the wideband audio may be white noise, running water, static, or other similar types of sounds.

At 812, the device may measure and record a second current of a second resulting audio signal associated with the wideband audio. For example, since the speaker is located in an environment with acoustic reflection, the second current measured may be representative of the current of the audio signal plus a ghost echo current. The second current may be stored or recorded on the computer readable media (e.g., computer readable media 320 or computer readable media 422).

At 814, a second impulse response of the audio signal may also be determined by applying the channel estimation algorithm to the second current. For example, a least mean square algorithm may be applied to the second current to determine a transfer function of the audio signal. In some cases, the second impulse response of the second current may be stored with the second current or in lieu of the second current, as discussed above at 812.

At 816, the device may determine a third impulse response of the ghost echo current by comparing the first impulse response to the second impulse response. Alternatively, the device may determine the ghost echo current by comparing the first current to the second current.

Figure 9:
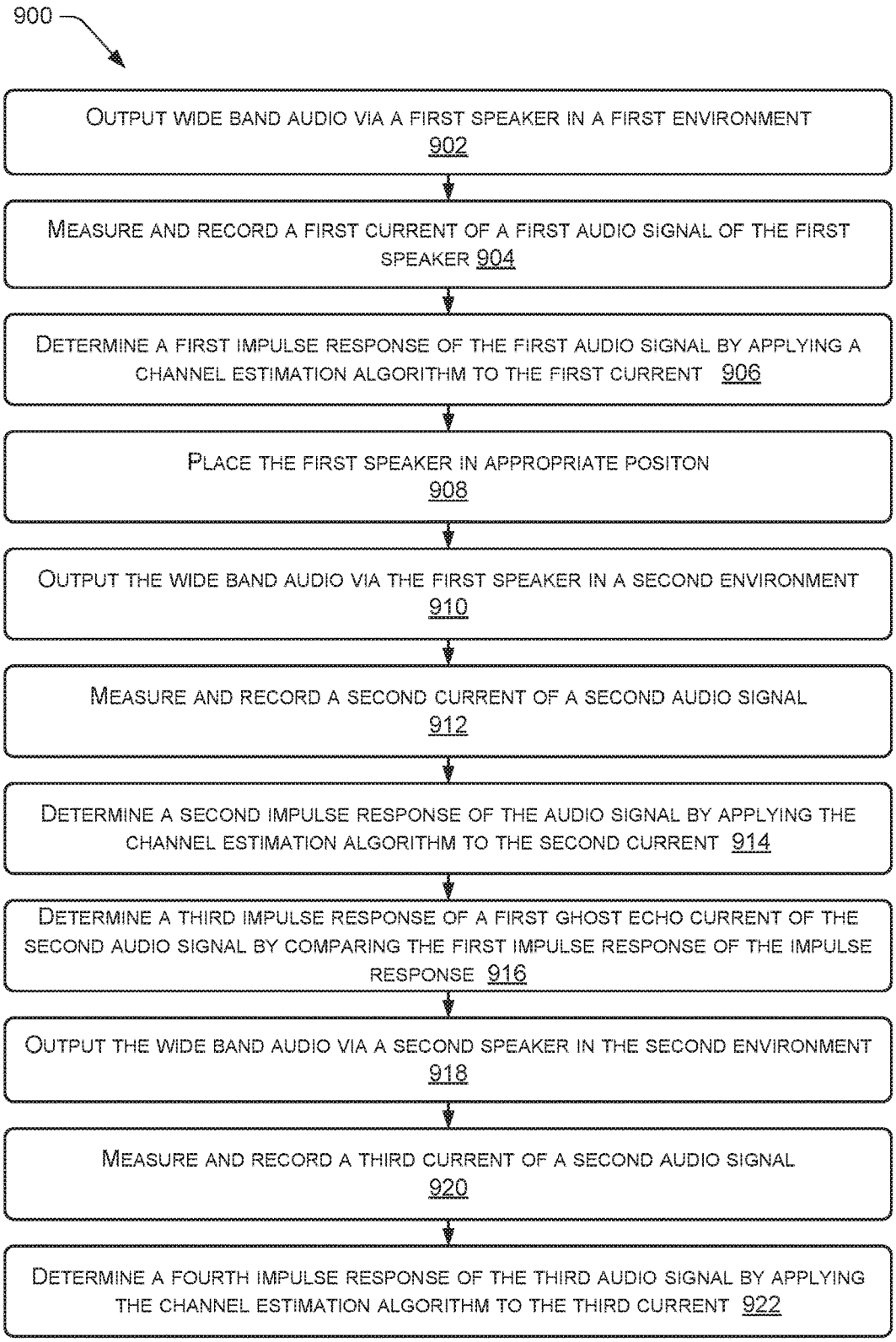
FIG. 9 is another example flow diagram showing an illustrative process for measuring a ghost echo according to some implementations.

FIG. 9 is another example flow diagram showing an illustrative process 900 for measuring a ghost echo according to some implementations. As described above, sound is produced by diving a current through a speaker. The current causes the speaker driver to vibrate or move and the sound is output into the environment. The motion of the driver generates sound pressure waves that travel out of the speaker enclosure into an environment. In one example, the speaker may be part of a surround sound system and the sound pressure waves created by another speaker in addition to the sound waves generated by the speaker may reflect off the environment, and return to the original speaker. As a result, the speaker may act as a microphone capturing incidental sound waves thereby generating a ghost current that flows backward toward the amplifier degrading the audio signal.

At 902, a first speaker may output wideband audio as sound into a first environment. For example, the first environment may be free of acoustic reflection. In some cases, the wideband audio may be white noise, running water, static, or other similar types of sounds.

At 904, a device, such as the sound quality device of FIGS. 3-7, may measure and record a first current of a first resulting audio signal associated with the wideband audio output by the first speaker. For example, since the first speaker is located in an environment without acoustic reflection, the first current measured may be measured while the wideband audio is output as sound is representative of the current of the audio signal without the introduction of a ghost echo current. The first current may then be stored or recorded on a computer readable media (e.g., computer readable media 320 or computer readable media 422).

At 906, a first impulse response of the first audio signal is determined by applying a channel estimation algorithm to the first current. For example, a least mean square algorithm may be applied to the first current to determine a transfer function of the first audio signal. In some cases, the first impulse response of the first current may be stored with the first current or in lieu of the first current, as discussed above at 904.

At 908, the first speaker may be placed in an appropriate position. The first speaker may be placed in a second environment at which the first speaker is intended to be used. In some cases, the first speaker may be placed in the second environment with other additional speakers. For example, the first speaker may be placed in a home, office, etc., as part of an entertainment system.

At 910, the first speaker may output the wideband audio into the second environment. For example, the second environment may be an environment in which acoustic reflection is present and, thus, the first speaker together with the other speakers in the second environment may causes the introduction of a ghost echo current during output. As discussed above, in some cases, the wideband audio may be white noise, running water, static, or other similar types of sounds.

At 912, the device may measure and record a second current of a second resulting audio signal associated with the wideband audio. For example, since the second environment has acoustic reflection, the second current measured may be representative of the current of the second audio signal plus a ghost echo current. The second current may then be stored or recorded on the computer readable media (e.g., computer readable media 320 or computer readable media 422).

At 914, a second impulse response of the second audio signal may also be determined by applying the channel estimation algorithm to the second current. For example, a least mean square algorithm may be applied to the second current to determine a transfer function of the second audio signal. In some cases, the second impulse response of the second current may be stored with the second current or in lieu of the second current.

At 916, the device may determine a third impulse response of the ghost echo current by comparing the impulse response to the second impulse response. Alternatively, the device may determine the ghost echo current by comparing the first current to the second current.

At 918, a second speaker may output the wideband audio into the second environment. For example, sound pressure output by the second speaker into the second environment may introduce additional ghost echo current into the second audio signal being output by the first speaker. In some cases, the second speaker may output the wideband audio when all other speakers including the first speaker are keep silent.

At 920, the device may measure and record a third current of a third resulting audio signal of the first speaker. For example, since the second environment has acoustic reflection, the third current measured may be representative of a second ghost echo current generated by the second speaker. The third current may then be stored or recorded on the computer readable media (e.g., computer readable media 320 or computer readable media 422).

At 922, a fourth impulse response of the third audio signal may also be determined by applying the channel estimation algorithm to the third current. For example, a least mean square algorithm may be applied to the third current to determine a transfer function of the third audio signal. In some cases, the fourth impulse response of the third current may be stored with the third current or in lieu of the third current.

With respect to the process 900 described above, if additional speakers are utilized in the second environment, the steps 918-922 may be repeated for each additional speaker to determine the ghost echo current in the second audio signal introduced by each additional speaker. Additionally, the impulse response of a ghost echo current introduced by each speaker may be stored on the device and utilized to reduce the effect of the ghost echo currents on the audio output by the first speaker.

Figure 10:
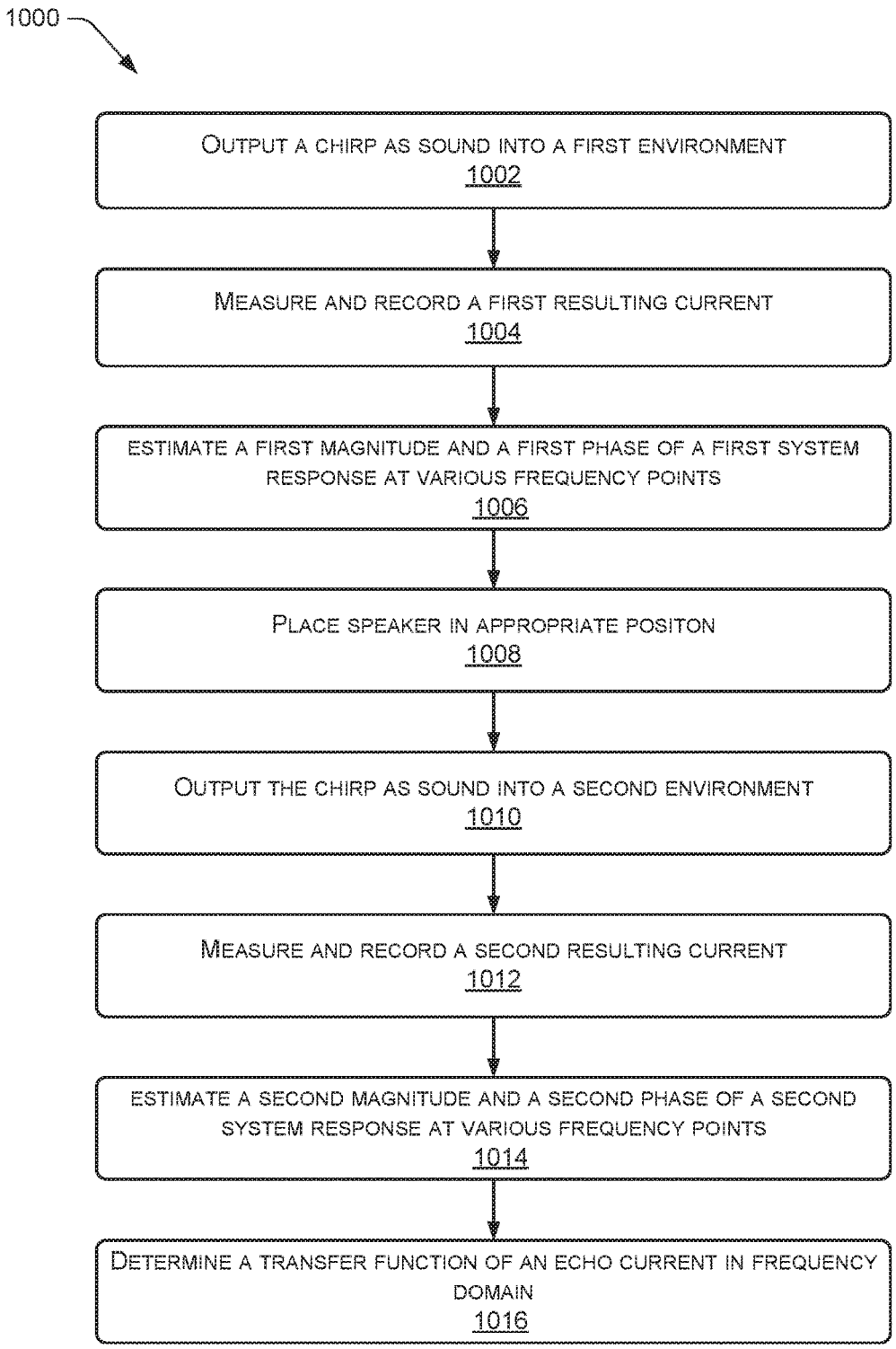
FIG. 10 is an example flow diagram showing an illustrative process for measuring a ghost echo according to some implementations.

FIG. 10 is another example flow diagram showing an illustrative process 1000 for measuring a ghost echo according to some implementations. In the processes 800 and 900 described above the ghost echo current and/or the impulse response of the ghost echo current is determined in the time domain. The process 1000 is an example process for measuring the ghost echo current in the frequency domain.

At 1002, a speaker may output a chirp into a first environment. For example, as discussed above, the first environment may be free of acoustic reflection. In some cases, the chirp may be a swept tone, stepped tone, or other high pitch noises.

At 1004, a device, such as the sound quality device of FIGS. 3-7, measures and records a first resulting current. For example, the device may measure and record the first resulting current at various frequency points. In some cases, the various frequency points may be preselected or predetermined. In other cases, the various frequency points may be a random sampling over the acoustic frequency range.

At 1006, the device may estimate a first magnitude and a first phase of a first system response based at least in part on the first resulting current and/or data associated with the various frequency points.

At 1008, the speaker may be placed in an appropriate position. For example, the speaker may be placed in a second environment at which the first speaker is intended to be used. In some cases, the speaker may be placed in the second environment with other additional speakers. For example, the speaker may be placed in a home, office, etc., as part of an entertainment system. In other instances, the speaker may be part of an earbud or headphones and the speaker may be placed on an ear of a listener.

At 1010, the speaker may output the chirp into the second environment. For example, the second environment may be an environment in which acoustic reflection is present and, thus, the speaker may causes the introduction of a ghost echo current when outputting audio as sound.

At 1012, the device measures and records a second resulting current. For example, the device may measure and record the second resulting current at various frequency points. In some cases, the various frequency points may be preselected or predetermined. In other cases, the various frequency points may be a random sampling over the acoustic frequency range. In one example, the various frequency points may be the same frequency points at which the first resulting current was measured.

At 1014, the device may estimate a second magnitude and a second phase of a second system response based at least in part on the second resulting current and/or second data associated with the various frequency points.

At 1016, the device may determine a transfer function of a ghost echo current in the frequency domain. For example, the transfer function may be determined based at least in part on the second magnitude and the second phase of the second system together with the first magnitude and the first phase of the first system. The transfer function may then be used to model the speaker to determine the ghost echo current of other audio signals output by the speaker.

Figure 11:
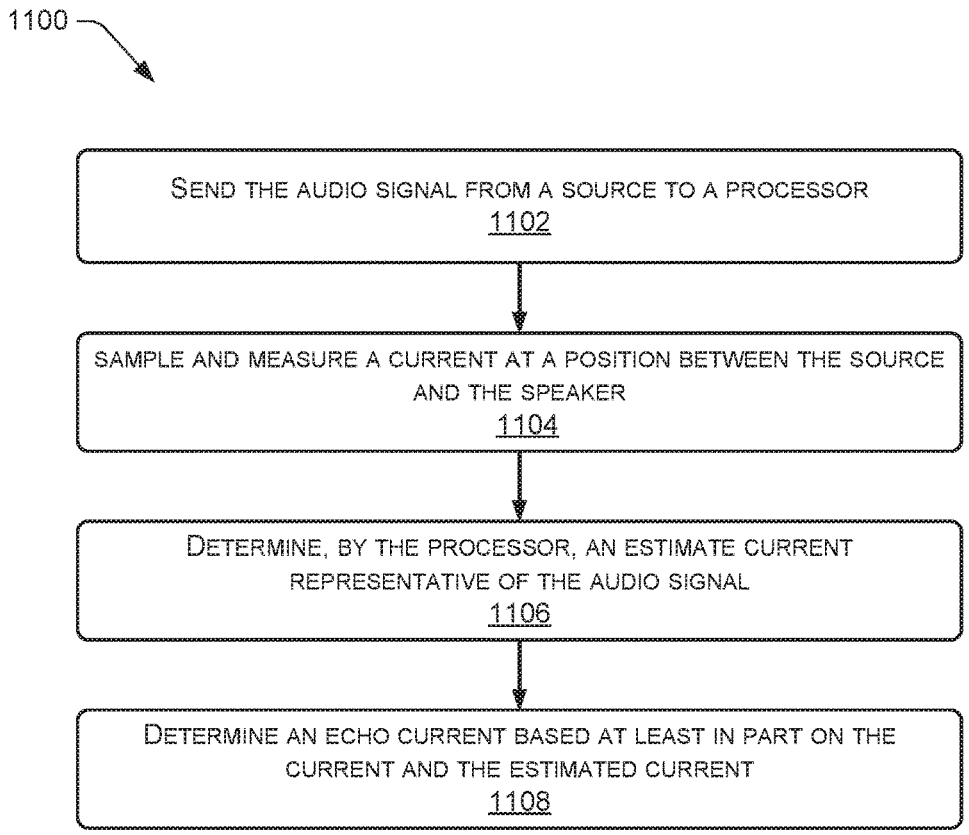
FIG. 11 illustrates an example architecture of a sound quality device of FIGS. 3-6 according to some implementations.

FIG. 11 is an example flow diagram showing an illustrative process 1100 for measuring a ghost echo according to some implementations. In some cases, a device, such as the sound quality device of FIGS. 3-7, may be configured to detect a ghost echo current in an audio signal in substantially real time.

At 1102, an audio source may send an audio signal to a speaker. The speaker may output an audio signal as sound into an environment. As the speaker outputs sound, a speaker driver may move generating a sound pressure wave. The sound pressure wave may reflect off of the environment and be captured by the speaker generating a ghost echo current along the audio signal path.

At 1104, the device may sample and measure a current at a position between the source and the speaker. The measured current includes a current associated with the audio signal and the ghost echo current mixed with the current associated with the audio signal.

At 1106, the device may determine an estimated current associated with the audio signal. The estimated current may be representative of a current of the audio signal without the presence of the ghost echo current. For example, the device may receive the audio signal at a communication interface and apply the audio signal to a model associated with the speaker to determine the estimated current.

At 1108, the device may determine a ghost echo current based at least in part on the measured current and the estimate current. For example, a first impulse response may be determined by applying a channel estimation algorithm to the measured current. A second impulse response may be determined by applying the channel estimation algorithm to the estimated current. An impulse response of the ghost echo current may then be determined form the first impulse response and the second impulse response. In some examples, the impulse response of the ghost echo current may be utilized to reduce the effect of the ghost echo current on the audio output as sound into the environment.

Figure 12:
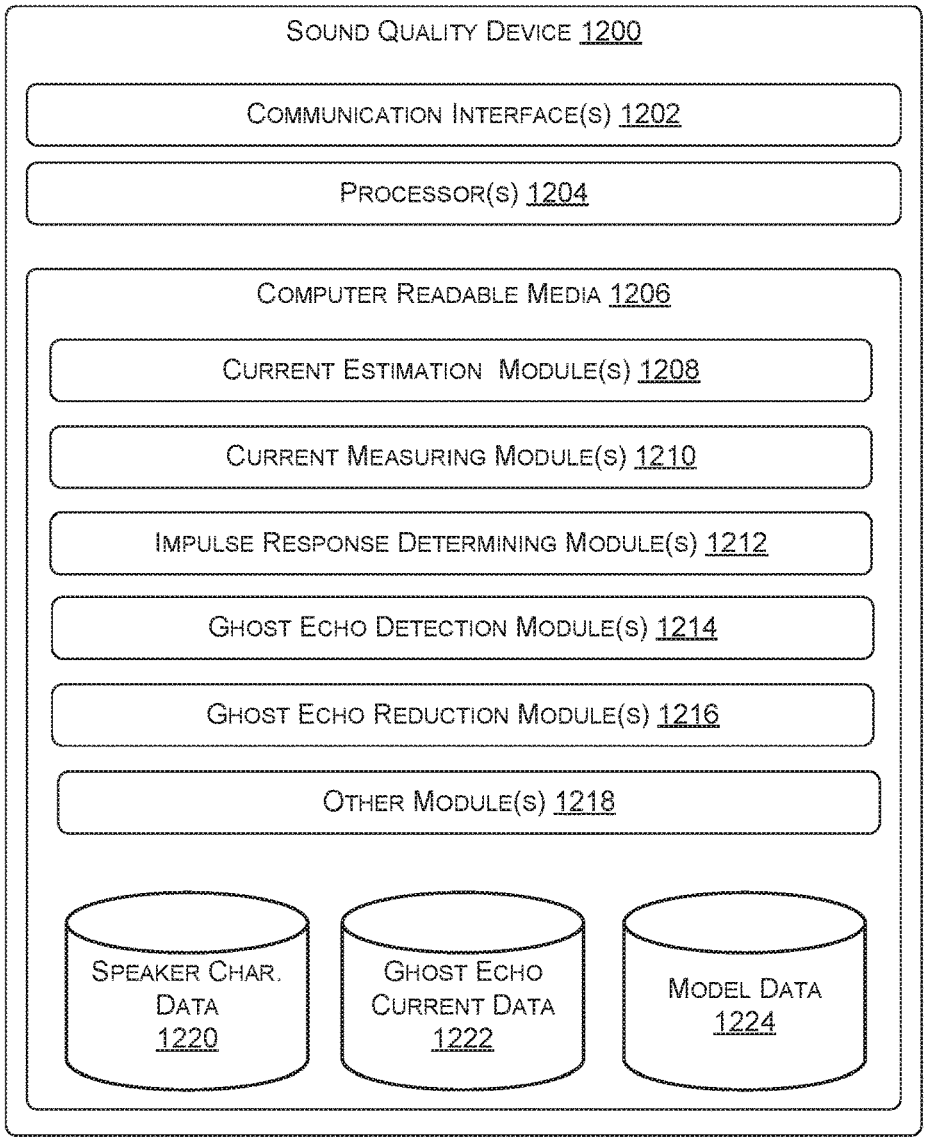
FIG. 12 illustrates an example architecture of an audio source of FIGS. 3-6 according to some implementations.

FIG. 12 illustrates an example architecture of a sound quality device 1200 of FIGS. 3-7 according to some implementations. The sound quality device 1100 may be coupled between an audio source and an output device to detect, measure, and/or remove a ghost echo current from an audio signal.

The sound quality device 1200 includes one or more communication interfaces 1202 to facilitate communication between one or more networks (such as the Internet® or one or more local area networks), directly with one or more devices (such as the audio source), and/or with one or more cloud services. The communication interfaces 1102 may also facilitate communication between one or more wireless access points, a master device, and/or one or more other computing devices as part of an ad-hoc or home network system. The communication interfaces 1202 may support both wired and wireless connection to various networks, such as cellular networks, radio, WiFi networks, short-range or near-field networks (e.g., Bluetooth®), infrared signals, local area networks, wide area networks, the Internet, and so forth.

The sound quality device 1200 includes or accesses components such as at least one or more control logic circuits, central processing units, or processors 1204, and one or more computer-readable media 1206 to perform the function of the device 1200. Additionally, each of the processors 1204 may itself comprise one or more processors or processing cores.

Depending on the configuration of the device 1200, the computer-readable media 1206 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 1204.

Various instruction, information, data stores, and so forth may be stored within the computer-readable media 1206 and configured to execute on the processors 1204. For instance, the computer-readable media 1206 may store a current estimation module 1208, a current measuring module 1210, an impulse determining module 1212, a ghost echo detection module 1214, a ghost echo reduction module 1216, as well as other modules 1218. The computer-readable media 1206 may also store a data, such as speaker characteristic data 1120, ghost echo data 1222, and/or model data 1224 that may be used to detect, measures, and reduce a ghost echo current.

The current estimation module 1208 may be configured to determine an estimated current representative of a current associated with the audio signal without the introduction of a ghost echo current. For example, the audio signal may be received at the communication interface 1202 and processed by the current estimation module 1208 independently of the audio signal being provided to the speaker and output as sound.

The current measuring module 1210 may be configured to measure a current associated with the audio signal being provided to the speaker. For example, the speaker may capture sound pressure waves reflecting off the environment as described above. The sound pressure waves may be converted into a ghost echo current that couples or mixes with the current of the audio signal and, thus, the current measured by the current measuring module 1210 may include the current of the audio signal and the ghost echo current.

The impulse determining module 1212 may be configured to apply a channel estimation algorithm, such as a least mean square algorithm to a current (e.g., the estimated current and/or the measured current) to determine a resulting impulse response associated with the current. In some cases, the impulse response may be used by an off line program (such as a pre-equalizer) operating on the audio source to pre-condition audio signals so that the ghost echo current may be substantially canceled.

The ghost echo detection module 1214 may be configured to detect and measure the ghost echo current within the measured current. For example, the ghost echo detection module 1214 may compare the measured current to the estimated current to identify the ghost echo current. In other cases, the ghost echo detection module 1214 may compare the impulse response determined form the measured current to the impulse response of the estimated current to determine an impulse response of the ghost echo current.

The ghost echo reduction module 1216 may be configured to remove of prevent the effect of the ghost echo current on the audio output as sound by the speaker. For example, the ghost echo reduction module 1216 may process the audio signal based at least in part on the impulse response of the ghost echo current to reduce the effect of the ghost echo current the outputted sound.

In some cases, the speaker characteristic data 1220 may include data related to one or more speakers that may be utilized to output the audio signal as sound. In one example, the speaker characteristics data 1220 may be utilized by the current estimation model 1208 to assist in determining the estimated current with respect to a speaker currently coupled to the device 1200. The ghost echo current data 1222 may include the ghost echo current and/or the impulse response of the ghost echo current to assist with the removal or minimization of the ghost echo current by the ghost echo reduction model 1216. The model data 1224 may include an electrical model of the speaker that may be utilized by the current estimation module 1208 to determine the estimated current.

Figure 13:
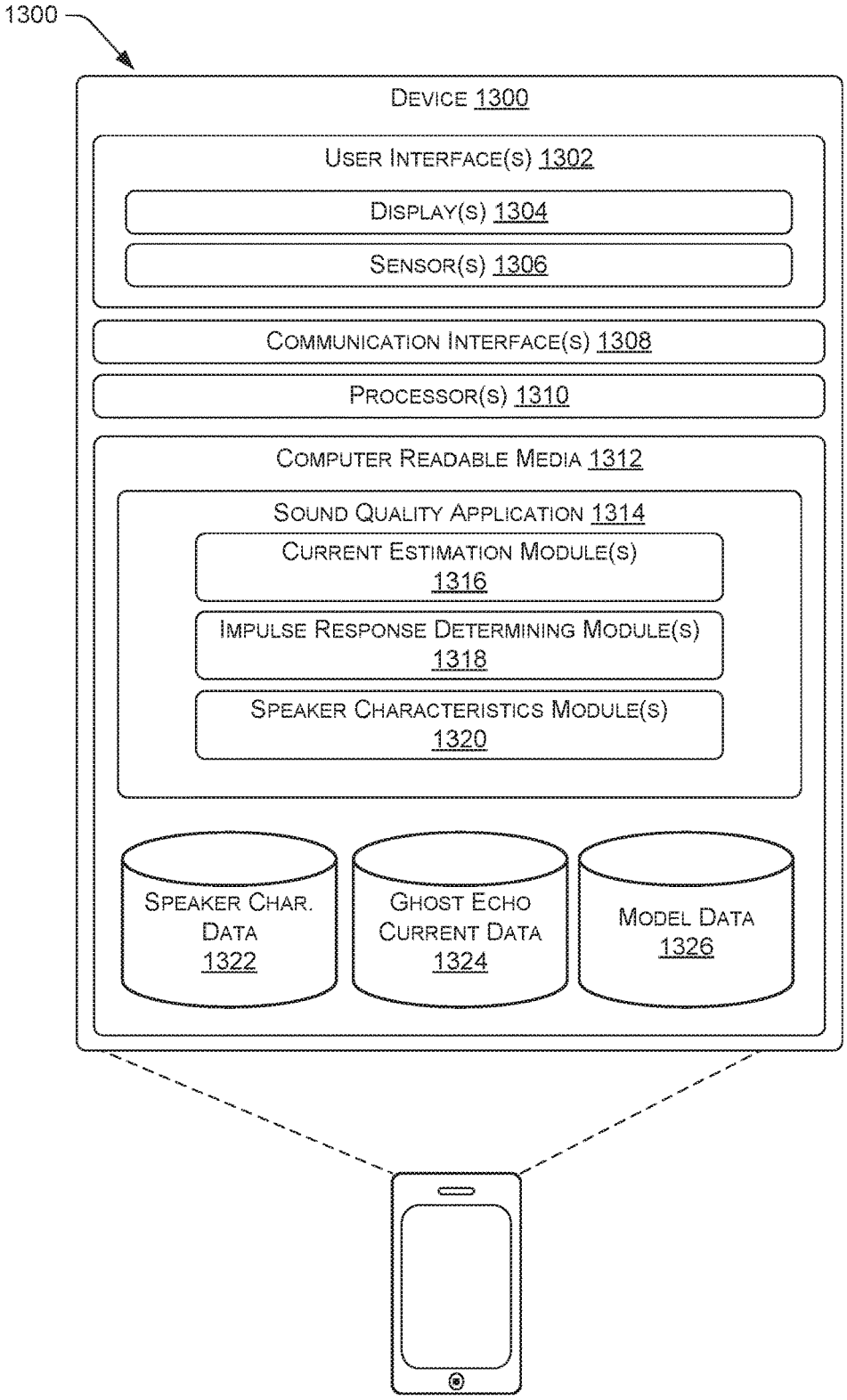
FIG. 13 illustrates an example architecture of an audio source of FIGS. 3-7 according to some implementations.

FIG. 13 illustrates an example architecture of an audio device 1300 of FIGS. 3-7 according to some implementations. In some implementations, the audio device may host or include a sound quality application associated with a sound quality device. For example, the audio device may be a cellular telephone, smart phone, portable media player, tablet computer, wearable computer, laptop computer, netbook, desktop computer, television, appliance, home electronic device, automotive electronic device, augmented reality device, and so forth.

The device 1300, generally, includes one or more user interfaces 1302 for presenting information or data and for receiving user inputs. The user interfaces 1302 may include one or more output components, such as a display or touch screen, and one or more input components, such as keyboards, keypads, joysticks, a mouse, a touch screen, touch pad, drawing pad, or control buttons. In some implementations, the output components and input components are combined in a single user interface 1302 to provide a touch-sensitive display, or touch screen display. For instance, in the illustrated example, the user interface 1302 includes one or more displays 1304 for presenting information, such as data related to a hearing assessment or selectable options associated with an audio track, to a user, one or more sensors 1306 for accepting input resulting from contact and/or application of incident force, such as a user finger or stylus pressing upon one of the sensor 1306. In some specific implementations, the device 1300 may be configured to receive user inputs by communicating with an active stylus or other remote control device. For example, the active stylus and the device 1300 may actively exchange data related to the user inputs.

The device 1300 also includes one or more communication interfaces 1308 to facilitate communication between one or more networks (such as the Internet® or one or more local area networks), directly with one or more devices (such as a sound quality device), and/or with one or more cloud services (such as an audio streaming service). The communication interfaces 1308 may also facilitate communication between one or more wireless access points, a master device, and/or one or more other computing devices as part of an ad-hoc or home network system. The communication interfaces 1308 may support both wired and wireless connection to various networks, such as cellular networks, radio, WiFi networks, short-range or near-field networks (e.g., Bluetooth®), infrared signals, local area networks, wide area networks, the Internet, and so forth.

The device 1300 includes or accesses components such as at least one or more control logic circuits, central processing units, or processors 1310, and one or more computer-readable media 1312 to perform the function of the device 1300. Additionally, each of the processors 1310 may itself comprise one or more processors or processing cores.

Depending on the configuration of the device 1300, the computer-readable media 1312 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 1310.

Various instruction, information, data stores, and so forth may be stored within the computer-readable media 1312 and configured to execute on the processors 1310. For instance, the computer-readable media 1312 may store one or more applications, such as a sound quality application 1314. In some cases, the sound quality application 1314 may include instructions which when executed by the processors 1310 cause the device 1300 to improve the user's listening experience. For example, in the illustrated example, the sound quality application 1314 may include a current estimation module 1316, an impulse response determining module 1318, and/or a speaker characteristics module 1320.

The computer-readable media 1312 may also store various data associated with the sound quality application 1314. For example, the computer-readable media 1312 may store speaker characteristics data 1322, ghost echo current data 1324, and/or model data 1326. In some cases, the speaker characteristic data 1322 may include data related to one or more speakers that may be utilized to output the audio signal as sound. In one example, the speaker characteristics data 1322 may be utilized by the current estimation model 1316 to assist in determining the estimated current with respect to a speaker currently coupled to the device 1300. The ghost echo current data 1324 may include the ghost echo current and/or the impulse response of the ghost echo current. The model data 1326 may include various models that may be utilized by the current estimation module 1316 to determine the estimated current.

The current estimation module 1316 may be configured to determine an estimated current representative of a current associated with the audio signal without the introduction of a ghost echo current. For example, the audio signal may be processed by the current estimation module 1316 independently of the audio signal being provided to the speaker and output as sound.

The impulse determining module 1318 may be configured to apply a channel estimation algorithm, such as a least mean square algorithm to the estimated current to determine a resulting impulse response associated with the estimated current that may be used to determine the impulse response of the ghost echo current by the sound quality application 1314 and/or a sound quality device.

The speaker characteristics module 1320 may be configured to allow a user to enter the speaker characteristics data 1322 via the user interface 1302 and/or data that may be utilized by the speaker characteristics module 1320 to identify (such as via the Internet®) the speaker characteristics data 1322 associated with a current speaker. For example, a speaker identifier may be enter by a user at the user interface 1302 and the speaker characteristics module 1320 may include a WebCrawler configured to identify the speaker characteristics data 1322 based on the speaker identifier.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A device comprising:

an input interface releasably coupled to an audio source;

an output interface releasably coupled to an output device;

a path from the input interface to the output interface to allow a current associated with an audio signal generated by the audio source to reach the output device;

a current sense to sample the current to determine a measured current;

a communication interface to receive the audio signal from the audio source independently from the path;

a modeling component to determine an estimated current based at least in part on the audio signal;

a compare component to determine a ghost echo current based at least in part on the measured current and the estimated current.

2. The device as recited in claim 1, wherein the compare component:

determines a first impulse response by applying a first channel estimation algorithm to the measured current;

determines a second impulse response by applying a second channel estimation algorithm to the estimated current; and determines a third impulse response of the ghost echo current based at least in part on the first impulse response and the second impulse response.

3. The device as recited in claim 2, wherein the first channel estimation algorithm is a least mean square algorithm.

4. The device as recited in claim 2, wherein the first channel estimation algorithm and the second channel estimation algorithm are identical.

5. The device as recited in claim 2, wherein the first channel estimation algorithm and the second channel estimation algorithm are different.

6. The device as recited in claim 2, further comprising a ghost echo processing component to reduce the ghost echo current on the path based at least in part on the third impulse response.

7. The device as recited in claim 1, further comprising a ghost echo processing component to modify the current on the path based at least in part on the ghost echo current.

8. The device as recited in claim 1, wherein:

the communication interface is further configured to receive speaker characteristics; and the modeling component determines the estimated current based at least in part on the speaker characteristics.

9. The device as recited in claim 1, wherein the communication interface sends the ghost echo current to the audio source.

10. A method comprising:

causing a first speaker to output sound into a first environment;

measuring a first current associated with the sound being output by the first speaker;

determining a first impulse response associated with the first current;

causing the first speaker to stop outputting the sound into the first environment;

causing the first speaker to output the sound into a second environment;

measuring a second current associated with the sound being output by the first speaker in the second environment;

determining a second impulse response associated with the second current;

determining a third impulse response of a first ghost echo current associated with the first current based at least in part by on the first impulse response and a second impulse response;

causing the first speaker to stop outputting the sound into the second environment;

causing a second speaker to output the sound into the first environment;

measuring a third current associated with the sound being output by the second speaker in the first environment;

determining a fourth impulse response associated with the third current; and determining a fifth impulse response of a second ghost echo current associated with the second current based at least in part by on the fourth impulse response and the third impulse response.

11. The method as recited in claim 10, wherein determining the first impulse response includes applying a channel estimation algorithm to the first current.

12. The method as recited in claim 10, wherein determining the first impulse response includes applying a least mean square algorithm to the first current.

13. The method as recited in claim 10, wherein the sound is wideband noise.

14. The method as recited in claim 10, wherein the first environment is an ear channel.

15. A method comprising:

causing a first speaker to output an audio signal as sound into an ear canal;

measuring a first current associated with the sound being output by the first speaker;

determining a first magnitude associated with a first system response based at least in part on the first current;

determining a first phase associated with the first system response based at least in part on the first current; and determining a transfer function of a ghost echo current associated with the first current based at least in part by on the first magnitude, the first phase, a second magnitude, and a second phase, the second magnitude and the second phase determined based at least in part on a second current sampled while the speaker outputs the sound into a second environment, the second environment different from the ear canal and being an acoustic non-reflective environment, the ghost echo current representing a reflection of sound pressure within the ear canal captured by the first speaker, the reflection of sound pressure created in response to movement of a speaker driver of the first speaker within the ear canal.

16. The method as recited in claim 15, wherein the first magnitude and the first phase are determined at a plurality of predetermined frequency points.

17. The method as recited in claim 15, wherein the sound is at least one high pitched tone.

18. The method as recited in claim 15, wherein the sound includes at least one of a chirp, swept tone, or stepped tone.

19. The method as recited in claim 10, wherein determining the third impulse response of the first ghost echo is based at least in part on the first current and the second current.

20. The method as recited in claim 10, wherein measuring the first current includes measuring the first current at a position between an audio source and the first speaker.

* * * * *